US005999079A

United States Patent [19]

Wille

[11] Patent Number: 5,999,079

[45] Date of Patent: Dec. 7, 1999

[54] MAGNET COIL WITH RADIAL TERMINAL PINS AND THE METHOD FOR MANUFACTURING THE COIL

[75] Inventor: Roger Wille, Oostkamp, Belgium

[73] Assignee: Siemens Aktiengesellschaft, Munich, Germany

[21] Appl. No.: 08/939,352

[22] Filed: Sep. 29, 1997

[30] Foreign Application Priority Data

Sep. 30, 1996 [DE] Germany ..... 196 40 380

[51] Int. Cl.[6] ..... H01F 27/29; H01F 27/30

[52] U.S. Cl. ..... 336/192; 336/208

[58] Field of Search ..... 336/192, 208; 29/602.1

[56] References Cited

U.S. PATENT DOCUMENTS 4,890,085 12/1989 Saito et al. ..... 336/192
4,904,974 2/1990 Tsuji ..... 336/192
4,962,361 10/1990 Ida ..... 336/90
5,199,160 4/1993 Degenhart et al. ..... 336/192
5,696,477 12/1997 Yamamori et al. ..... 336/192

FOREIGN PATENT DOCUMENTS 0 482 694 4/1992 European Pat. Off. .

OTHER PUBLICATIONS

*Patent Abstract of Japan* for Japanese 61–94304 (May 13, 1986), vol. 18/No. 272, E–437 Sep. 16, 1986.

*Primary Examiner*—Lincoln Donovan
*Assistant Examiner*—Anh Mai
*Attorney, Agent, or Firm*—Hill & Simpson

[57] ABSTRACT

To form a magnet coil, the coil bobbin has L-shaped terminal pins embedded in an end portion of the bobbin with the short legs of the terminal pins extending axially and the long legs extending radially therefrom. This enables wrapping the ends of the wire being wound on the bobbin on the short legs and forming a molten connection by soldering or welding of the ends to the end faces of these short legs.

6 Claims, 1 Drawing Sheet

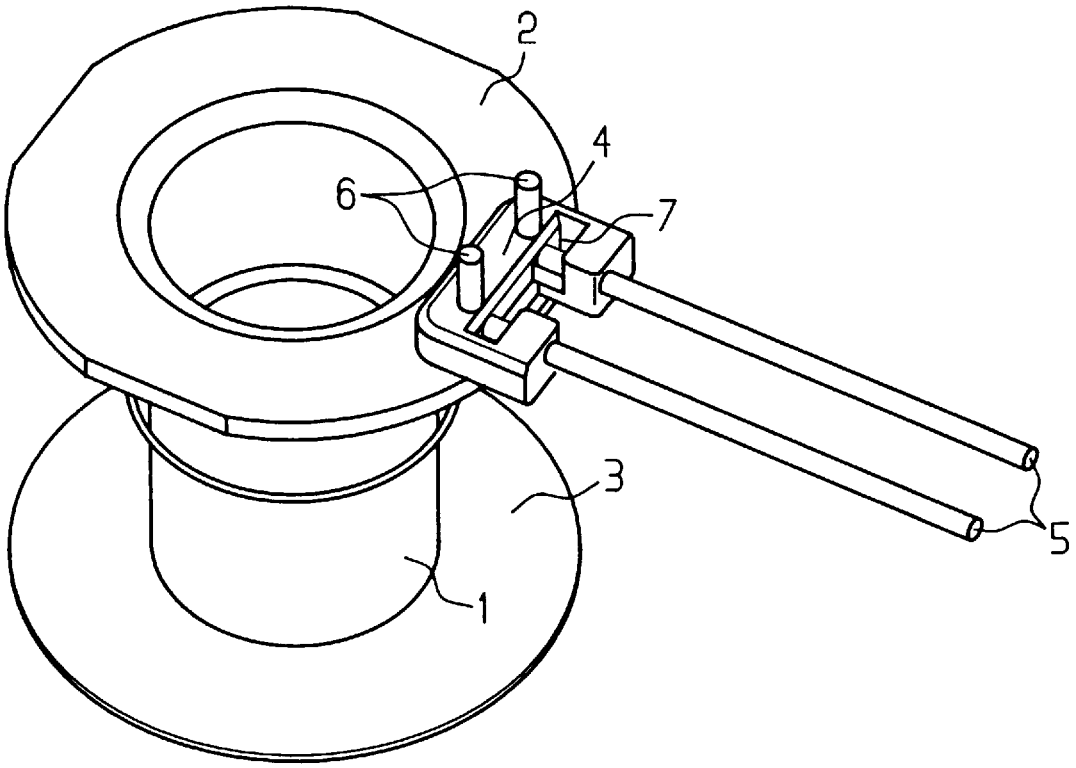
2
4
6
7
3
5
1

MAGNET COIL WITH RADIAL TERMINAL PINS AND THE METHOD FOR MANUFACTURING THE COIL

BACKGROUND OF THE INVENTION

The present invention is directed to a magnet coil with terminal pins projecting radially beyond the contour of the coil body and to a method for manufacturing the coil.

Magnet coils are particularly suited for utilization in the automotive field, for example as sensor coils or as valve coils for ABS systems.

Known magnet coils comprise terminal pins anchored in the end region of the coil bobbin and axially projecting therefrom. These known terminal pins can be angled-off or bent L-shaped, wherein the short legs form end regions arranged radially relative to the coil body formed by the bobbin on the coil side and to which the winding wire is soldered. The short L legs must thereby still be long enough that they project adequately far beyond the contour of the coil body in order to enable an immersion soldering process without damage to the coil parts.

A new coil configuration with radial terminal pins that is now strived for gives rise to various problems in view of the integration in an automated winding process and the final fastening of the winding wire ends at the coil side end regions. A wrapping and tinning over a significant part of the radial terminal pins, which can be several centimeters long under certain conditions, would involve a stressing of the terminal pins and an undesirable, high temperature stress of the plastic material of the insulating body. A welded connection would even be precluded from the very outset, since the welding bead at the end face of the terminal pins must be melted off, whereas the winding wire is meaningfully wrapped at the other end of the terminal pins in the proximity of the coil body or bobbin.

SUMMARY OF THE INVENTION

An object of the present invention is to create a magnet coil with radial terminal pins and a method for the manufacture of the magnet coil which solves the described manufacture-oriented problems.

These objects are achieved with a magnet coil with an essentially hollow-cylindrical coil bobbin composed of insulating material that is provided with two terminal pins anchored in an end face region of the coil bobbin and projecting radially therefrom and in that the pins wound with the wire are soldered or welded to the coil side in the regions of each of the terminal pins, wherein the terminal pins are bent in an L-shape and a short leg forms the coil side end regions that are arranged to project axially from the end face region of the coil body.

The invention is also directed to a method for manufacturing the magnet coil, which has a coil bobbin having an end face or flange with two terminal pins that radially project therefrom and have short L-shaped portions which extend axially from the end face of the end flange. The method includes providing a bobbin having an end flange with the pair of terminal pins having L-shaped legs, wrapping an end of a wire on one of the short legs of the L-shaped terminal pins by threading the end of the wire in a proximate recess adjacent the end face region of the coil bobbin and winding the end onto the short portion of the L-shaped pin, subsequently winding the wire in a winding space of the bobbin back and forth again to form the coil body and then threading the wire back to the end face and wrapping it onto the second of the two short legs and, finally, attaching the wire with a molten connection formed either by soldering or welding the wire to the end region of each of the short legs.

Other advantages and features of the invention will be readily apparent from the following description of the preferred embodiment, the drawing and claims.

BRIEF DESCRIPTION OF THE DRAWING

The FIGURE is a perspective view of a magnet coil bobbin of the present invention without the coil winding.

DESCRIPTION OF THE PREFERRED EMBODIMENTS

The coil bobbin or body 1 is composed of an insulating material having an upper face end region or flange 2, which has two terminal pins 5 projecting radially therefrom. The winding space 3 between the end face 2 and the opposite end face is empty in this drawing. The upper end face region or flange 2 is manufactured as one piece together with an anchoring region 4, in which the terminal pins 5 have been firmly seated or embedded. The terminal pins 5 each have been bent to have a short L-shaped leg 6, which will project axially from the end face region or flange 2 and away from the winding space 3. In the final condition, the coil side end regions which are formed by the short legs 6 of the pins 5, exhibit a length of approximately 2 mm. They can be approximately twice as long initially during the wrapping and can be subsequently cut off. The angled-off terminal pins 5 are, thus, anchored in the coil body or bobbin 1 and are protected against turning or being pulled therefrom.

In manufacturing the magnet coil, a start of the winding wire is initially wrapped at one of the short legs 6 with the guide of an automatic winding unit. Subsequently, the wire is threaded through a proximate recess 7 of the end face region of the coil body and led into the winding space and is subsequently wound thereon back and forth along the coil bobbin 1. Subsequently, the winding wire is then threaded back through the guide to the portion adjacent the short end 6 either through the same recess or in another recess. As shown, the recesses can be advantageously integrated into the anchoring region 4. The soldering or welding can occur after wrapping of the winding wire on the selected short leg 6.

In terms of winding technique, the wrapping regions on the legs 6 that are significantly shorter compared to the actual terminal pins 5 offer the advantage that the actual terminal pins remain, in particular, unstressed by the tinning when wrapping the winding wire and, thus, remain free of damage. In terms of soldering, tinning according to the invention no longer has to be carried out over the long terminal pins 5, but only over a short wrapping region on the legs 6 with the advantage of a better heat management and better anchoring protection.

At the same time, the shorter, angled-off wrapping regions of the legs 6 offer the possibility of utilizing a welding process, for example a Tungsten inert gas (TIG) welding of plasma welding. The two winding wire ends are thereby respectively fused by welding to an end face of the two short L-shaped legs 6. Because of the shortness of the legs, the wrapping zone is inventively located in the immediate proximity of these end faces to make the welding possible.

Although various minor modifications may be suggested by those versed in the art, it should be understood that I wish to embody within the scope of the patent granted hereon all such modifications as reasonably and properly come within the scope of my contribution to the art.

I claim:

1. A method for manufacturing a magnet coil comprising providing a coil bobbin having a winding space extending between end flanges, one of said end flanges having an anchor region being provided with two L-shaped terminal pins having a short leg of each terminal pin extending outward in the axial direction from an end face of the flange and the long leg extending in a radial direction, guiding an end of a wire through a recess adjacent a pin in the anchor region of the coil bobbin and winding the end of the wire on one of the short axially extending legs of the terminal pins, winding the wire in the winding space back and forth to form a coil winding, then threading the end of the wire of coil winding through a recess in the anchor region adjacent the other short leg of the other pin and wrapping the end thereon, and then securing the wires on the end regions of the pins by forming a molten connection.

2. A method according to claim 1, wherein the step of forming a molten connection includes welding.

3. A method according to claim 1, wherein the step of forming a molten connection includes soldering.

4. A method according to claim 1, wherein the two winding wire ends are respectively fused by welding to the end faces of the two short legs of the L-shaped terminal pins.

5. A magnet coil comprising an essentially hollow-cylindrical coil bobbin having a winding space between end flanges, one of the end flanges having an anchor region on a periphery of the flange, two terminal pins with each pin having a short leg extending at a right angle to a long leg, said pins being embedded in the anchor region with the short legs extending axially outward from an end face of the end flange and with the long legs extending in a radial direction, a recess in the anchor region adjacent each pin, the short legs forming a coil side end region, and said coil being wound with a wire with each recess receiving an end of the wire which is attached to the short leg of the adjacent pin.

6. A magnet coil according to claim 5, wherein the pins are metal pins with the legs having a cylindrical shape.

* * * * *